US009755345B2

(12) United States Patent
Rosenberger

(10) Patent No.: US 9,755,345 B2
(45) Date of Patent: Sep. 5, 2017

(54) CONTACT ELEMENT AND METHOD FOR ITS MANUFACTURE

(71) Applicant: ROSENBERGER HOCHFREQUENZTECHNIK GMBH & CO. KG, Fridolfing (DE)

(72) Inventor: Bernd Rosenberger, Tittmoning (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/441,968

(22) PCT Filed: Oct. 30, 2013

(86) PCT No.: PCT/EP2013/003276

§ 371 (c)(1),
(2) Date: May 11, 2015

(87) PCT Pub. No.: WO2014/090356

PCT Pub. Date: Jun. 19, 2014

(65) Prior Publication Data

US 2015/0280346 A1 Oct. 1, 2015

(30) Foreign Application Priority Data

Dec. 11, 2012 (DE) ..... 10 2012 024 185

(51) Int. Cl.
*H01R 13/24* (2006.01)
*H01R 43/16* (2006.01)

(52) U.S. Cl.
CPC ..... *H01R 13/2428* (2013.01); *H01R 43/16* (2013.01)

(58) Field of Classification Search
CPC ..... H01R 13/2428; H01R 13/2421
USPC ..... 439/700, 824
See application file for complete search history.

(56) References Cited

U.S. PATENT DOCUMENTS 6,506,082 B1 * 1/2003 Meek ..... H01R 13/2421 439/700
6,776,668 B1 8/2004 Scyoc et al.
6,855,010 B1 * 2/2005 Yen ..... H01R 13/2428 439/700
7,078,921 B2 * 7/2006 Haga ..... G01R 1/06738 324/755.05
7,559,769 B2 * 7/2009 Hsiao ..... H01R 12/52 439/66
8,052,491 B2 * 11/2011 Lin ..... H01R 13/2421 439/700

(Continued)

FOREIGN PATENT DOCUMENTS

CN 1496482 A 5/2004
CN 201000993 1/2008

(Continued)

*Primary Examiner* — Tulsidas C Patel
*Assistant Examiner* — Marcus Harcum
(74) *Attorney, Agent, or Firm* — DeLio, Peterson & Curcio, LLC; Robert Curcio

(57) ABSTRACT

A contact element having contact points for the electrically conductive connection of contact regions of mutually spaced elements, which is formed completely of one or more deposited materials of which at least one is electrically conductive. The contact element is produced in particular using a lithography, electroplating and molding (LiGA) method.

15 Claims, 8 Drawing Sheets

(56) References Cited

U.S. PATENT DOCUMENTS

| | | | | |
|---|---|---|---|---|
| 8,262,419 | B2 * | 9/2012 | Chen | H01R 13/2421 439/700 |
| 2004/0214475 | A1 * | 10/2004 | Costello | F16B 21/071 439/700 |
| 2011/0177726 | A1 | 7/2011 | Koyama | |
| 2011/0252657 | A1 * | 10/2011 | Sato | G01R 1/06716 33/561 |
| 2012/0194173 | A1 * | 8/2012 | Takahashi | G01R 1/06716 324/149 |

FOREIGN PATENT DOCUMENTS

| | | | |
|---|---|---|---|
| EP | 0184608 | A2 | 6/1986 |
| JP | 2008546164 | A | 12/2008 |
| JP | 4803329 | B1 | 10/2011 |
| WO | 03066515 | A2 | 8/2003 |
| WO | 2006135680 | A2 | 12/2006 |

* cited by examiner

CONTACT ELEMENT AND METHOD FOR ITS MANUFACTURE

BACKGROUND OF THE INVENTION

1. Field of the Invention

The invention relates to a contact element having contact points for the electrically conductive connection of contact regions of mutually spaced elements, for example circuit boards. The invention also relates to a method for the manufacture of such a contact element as well as a contact device which comprises a plurality of such contact elements.

2. Description of Related Art

Contact elements of the generic type are for example used to form so-called board-to-board (B2B) connectors, by means of which two circuit boards arranged at a distance from one another are connected in an electrically conductive manner.

The contact elements should thereby ensure an as far as possible loss-free transmission of the radio frequency signals, including within a defined tolerance range in terms of parallel alignment and spacing as well as any lateral offset of the two circuit boards or their contact regions. Further requirements are economical manufacture and simple assembly. In addition, the axial and radial dimensions of the contact elements should be as small as possible, since the continuing further miniaturization of circuit boards and the circuit traces applied to them means that the number of contact elements which need to be arranged next to one another within a limited space is increasing all the time.

It is known for a connection between two circuit boards to be established by means of two coaxial plug connectors permanently connected with the circuit boards together with an adapter connecting the two coaxial plug connectors, the so-called "bullet". This adapter makes possible a compensation of axial and radial tolerances, as well as the compensation of parallel alignment tolerances. Typical coaxial plug connectors used for this purpose are SMP, Mini-SMP or FMC.

Alternatively, electrical connections between two circuit boards are also realized by means of spring-loaded contact pins in individual conductor and/or multiple conductor design. Such spring-loaded contact pins comprise a sleeve and head which is partially guided within the sleeve as well as a helical spring which is supported between the head and the sleeve. The properties required of the helical spring in terms of spring force and block length demand relatively long spring lengths, which have a correspondingly disadvantageous effect on the axial construction height of the spring-loaded contact pins.

A coaxial contact element is also known from U.S. Pat. No. 6,776,668 B1 by means of which radio frequency signals are to be transferred between two circuit boards. An inner conductor, which is designed in the form of a spring-loaded contact pin, serves as a signal conductor, while an outer conductor surrounding the inner conductor performs the function of a return conductor as well as acting as a shield for the inner conductor. The outer conductor comprises a sleeve-formed base body which is split several times in the longitudinal direction. The unsplit end of the base body forms on its end face a contact point for making contact with a contact region of one of the circuit boards. A sleeve of the outer conductor is guided displaceably on the base body and forms on one end face a contact point for making contact with a contact region of the other circuit board. A pre-tensioned spring is supported between the base body and the sleeve. When the two circuit boards are connected, both the head of the inner conductor and the sleeve of the outer conductor are displaced, with further tensioning of the relevant springs, as a result of which a more reliable contact pressure can be provided, despite possible tolerances in terms of the distance between the contact regions of the circuit boards. In addition, the splitting of the base body means that this also possesses a certain flexibility in a lateral direction, which is intended to ensure that even relatively large deviations in parallel alignment between the two contact regions can be compensated.

Fundamentally, the known contact elements have relatively large dimensions, which, moreover, as a result of their construction design and the resulting function, cannot be reduced indefinitely. For example, a reduction in the diameter of plug-socket connections such as are used, inter alia, in the aforementioned SMP plug connectors, is only possible up to a certain limit, since otherwise with the materials usually used problems would arise with regard to the strength of plug and socket, in particular when plugging together the plug connection.

SUMMARY OF THE INVENTION

Starting out from this state of the art, the invention was based on the problem of providing a contact element of the generic type which is distinguished through extremely small dimensions, making it possible to create a contact device in which the greatest possible number of such contact elements is accommodated within a predetermined space.

This problem is solved through a contact element according to the claims. A method for the manufacture of such a contact element is the subject matter of the claims as well. A contact device which comprises a plurality of such contact elements is a further subject matter of the claims. Advantageous embodiments of the contact element according to the invention are the subject matter of the claims and are explained in the following description of the invention.

The above and other objects, which will be apparent to those skilled in the art, are achieved in the present invention which is directed to a contact element including: for the electrically conductive connection of contact regions of mutually spaced elements, wherein the contact element is completely formed of one or more deposited materials, of which at least one is electrically conductive; a spring section which is elastically deformed when contact is made with the two contact regions; and a snap-lock connection which holds the contact element in a position in which the spring section is partially deformed.

The spring section is arranged between two rigid supporting sections, and may be meander-formed in design. The spring section may also include several coaxially arranged curved spring tabs, such that adjacent spring tabs make contact when contact is made with the two contact regions.

On a further deformation of the spring section, the sections forming the snap-lock connection slide against each other.

The snap-lock connection is formed by the supporting sections.

In a second aspect, the present invention is directed to a method for the manufacture of a contact element comprising forming the contact element using a LiGA method, wherein upon manufacture the contact element includes: contact points for the electrically conductive connection of contact regions of mutually spaced elements, wherein the contact element is completely formed of one or more deposited materials, of which at least one is electrically conductive; a spring section which is elastically deformed when contact is made with the two contact regions; and a snap-lock connection which holds the contact element in a position in which the spring section is partially deformed.

In the LiGA method, a plurality of connected contact elements is created which contact elements are subsequently separated. The contact elements are deformed following manufacture and possibly following separation in order to engage the snap-lock connection.

In a third aspect, the present invention is directed to a contact device having a mounting which possesses a plurality of through-openings, as well as having several contact element, each of which include: contact points for the electrically conductive connection of contact regions of mutually spaced elements, wherein the contact element is completely formed of one or more deposited materials, of which at least one is electrically conductive; a spring section which is elastically deformed when contact is made with the two contact regions; and a snap-lock connection which holds the contact element in a position in which the spring section is partially deformed; wherein the contact elements are arranged in the through-openings and wherein the sections of the contact elements containing the contact points project beyond the mounting.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 4:
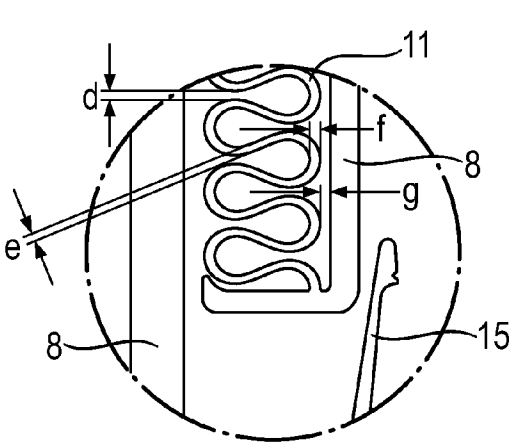
FIG. 4: shows an enlargement of the section IV in FIG. 2.
Figure 6:
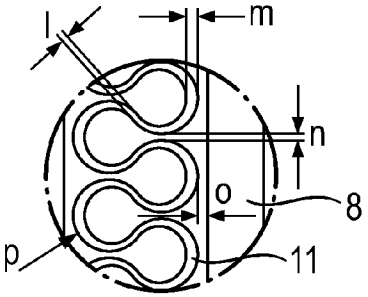
FIG. 6: shows an enlargement of the section VI in FIG. 2.

In describing the preferred embodiment of the present invention, reference will be made herein to FIGS. 1-26 of the drawings in which like numerals refer to like features of the invention.

The basic concept behind the invention is to achieve a miniaturization of a contact element of the generic type through the use of alternative manufacturing methods not previously used for the manufacture of such contact elements. This basic concept was also based on the knowledge that a simple miniaturization of the known contact elements cannot lead to success, among other things due to the strength problems already mentioned; rather, such miniaturization must at the same time be combined with a change in the functional design. A further realization was that such a functional redesign in combination with the desired dimensions can probably only be achieved if the contact element is formed as a single part. The alternative manufacturing method which was sought thus had to make it possible to create highly-complex geometries in extremely small dimensions at reasonable cost, whereby it had to be possible to process a material which allows the integration of the functionalities required of contact elements of the generic type.

This basic concept behind the invention is implemented in a (three-dimensional) contact element with contact points for the electrically conductive connection, bridging a space, of contact regions of mutually spaced elements, in particular circuit boards, which is formed completely of one or more deposited materials, of which at least one is electrically conductive.

The deposition of materials makes it possible to form extremely small yet highly complex geometries. Due to the electrically conductive properties and good elasticity of many metals, the preferred use of a metal for deposition and thus for the formation of the contact elements, which is also proposed, makes it possible to integrate in the miniaturized contact element the important functionalities required of contact elements of the generic type, namely electrical conductivity as well as the generation of a contact pressure ensuring a good contact between the contact points and the contact regions of the elements which are to be connected. Instead of forming the contact element completely of one of more deposited metals, plastics, for example, can also be used. For this purpose, these should preferably display the required elasticity and/or be electrically conductive. Alternatively however, a contact element consisting in part of plastic can be made electrically conductive through the additional deposition of one or more metallic layers, in particular being coated in a final deposition step.

Any suitable method known from the prior art can be used for the deposition of the material or materials. Particularly preferred methods for the deposition and thus for the manufacture of a contact element according to the invention are the so-called LiGA methods. The term "LiGA" is a German acronym for the terms describing the key steps in this method "Lithographie, Galvanik, Abformung" (lithography, electroplating, and molding).

The LiGA method, or methods (numerous variants are possible) is distinguished in that it makes it possible to manufacture microstructures with extremely small dimensions of for example 0.2 μm, structure heights of up to 3 mm, and aspect ratios of for example 50 (for detailed structures, up to as much as 500) from, for example, plastics, metals or ceramics.

In order to manufacture a contact element by means of a LiGA method it can in particular be the case that a photosensitive or X-ray-sensitive resist layer of, in particular, polymethyl methacrylate (PMMA), is applied to a flat substrate, for example a silicon wafer or a polished plate of, for example, beryllium, copper, or titanium, which can be in the form of a negative resist, but is preferably a positive resist. If the substrate itself is not electrically conductive, this can be provided with a metallic seed layer. This can in particular be effected through "sputtering" or evaporation. The resist layer is then exposed and developed, as a result of which a negative form of the contact element which is to be manufactured is produced. In a deposition process, a material, preferably metal (or also several materials or metals, in layers) is deposited on the substrate in the negative form. Preferably, the material or materials are deposited galvanically, whereby other deposition processes, for example PVD or CVD, are also possible. Following removal of the remaining resist, there remain initially the substrate, the seed layer, and the deposited material. This can already constitute the contact element, insofar as an electrically conductive material, in particular a metal, was deposited in at least one layer. The contact element can then be detached from the substrate, for example through etching of the seed layer.

Alternatively, the finally deposited structure can also be used as the mold of a molding tool. For this purpose, a further deposition can take place with, in particular, an "overgrowth" (of a part of) the remaining resist layer and subsequent removal of the substrate and seed layer. The contact element which is to be manufactured can then be manufactured by means of injection molding or hot embossing, for example. This method is, in particular, suitable for the manufacture of a contact element or of a base body of the contact element which is made of plastic. If the plastic is not electrically conductive, then in addition an electrically conductive material, in particular, a metal, can be deposited in the form of a coating.

If deposited structures with a greater thickness are required, the described method can be used to create a mask, which is in turn then used for the selective exposure of a thicker resist layer. In these cases, gold is frequently deposited in the mask, which is distinguished through its effective absorption of X-ray radiation. In addition, the gold can be deposited on a titanium membrane (which was thus positioned between the substrate and the resist layer during the creation of the mask), which is distinguished through an extremely low absorption of X-ray radiation.

In particular, X-rays or ultraviolet (UV) light can be used for exposure of the resist layer, whereby the use of X-ray radiation tends to promise higher precision and the use of UV light lower costs.

In order to achieve the most economical possible manufacture of a contact element according to the invention by means of a method according to the invention, a plurality of directly or indirectly connected contact elements can preferably be created simultaneously by means of a LiGA method and subsequently separated.

In a preferred embodiment, the contact element according to the invention can possess (at least) one spring section which is elastically deformed when contact is made with the contact regions. This spring section, which is distinguished from the other section(s) of the contact element through a lower spring stiffness in relation to the direction of connection, i.e., the connecting line between the contact points, can in particular serve to compensate tolerances of form and position of the contact element and the contact regions which are to be connected as well as to ensure a defined contact pressure.

Particularly preferably, the spring section is arranged between two rigid supporting sections which do not deform, to any relevant or functional extent, under the forces which regularly occur when contact is made with the contact regions. The supporting sections can in particular ensure a good stability (against kinking) of the contact element.

The spring section can preferably be meander-formed. Such a spring section can readily be manufactured by means of the method according to the invention.

Alternatively, the spring section can possess several coaxially arranged curved spring tabs. Such spring tabs can also readily be manufactured according to the invention. Particularly preferably, it can also be the case that adjacent spring tabs make contact when contact is made with the two contact regions as a result of the deformation of the spring section. As a result, the spring section, insofar as this is part of the signal or current path, can have a relatively low electrical resistance.

In a further preferred embodiment of the contact element according to the invention, a snap-lock connection can be provided which holds the contact element in a position in which the spring section is partially deformed. This means that the spring section can already be pre-tensioned in an unloaded neutral position of the contact element, as a result of which this can already generate a relatively high contact pressure when contact is made with the contact regions with only a slight further deformation taking place.

It can also preferably be the case that that on a further deformation of the spring section the sections forming the snap-lock connection slide against one another. The sections forming the snap-lock connection (these can preferably be the supporting sections) can thus guide the relative movement of the sections connected through the spring section, thus positively influencing the stability of the contact element.

In order to manufacture such a contact element, it can be the case that the contact element(s) is/are only deformed in order to snap in the snap-lock connection(s) following manufacture and possibly following separation.

In a further preferred embodiment of the contact element according to the invention, a signal or current path can be formed between the contact points, which bypasses the spring section(s). This embodiment is based on the idea that the spring section is generally characterized by relatively small cross sections of the deposited electrically conductive materials and thus by a relatively high electrical resistance.

A signal or current path should thus extend, without including the spring section, over the other sections of the contact element, which preferably have larger cross-sectional areas.

A contact device according to the invention comprises a (preferably at least partially electrically insulating) mounting which possesses a plurality of through-openings arranged next to one another, as well as several contact elements according to the invention, whereby the contact elements are arranged in the through-openings of the mounting, with the sections containing the contact points projecting beyond the mounting. In this way, a simple-to-handle unit with a plurality of contact elements according to the invention can be created. In addition, the contact elements can be supported in the through-openings, in a lateral direction, by the mounting.

A first embodiment of a contact element 7 according to the invention is illustrated in FIGS. 1 to 6. According to the invention, the one-part contact element 7, formed of an electrically conductive metal, has been manufactured by means of a LiGA method, the fundamental method steps of which are illustrated by way of example in FIGS. 23 to 26.

Figure 23:
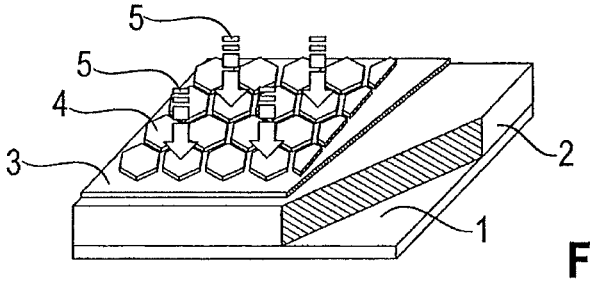
FIG. 23: shows a first step of a method according to the invention.
Figure 24:
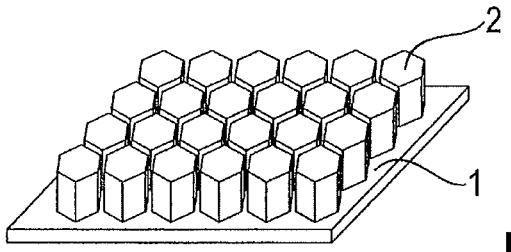
FIG. 24: shows a second step of a method according to the invention.

FIG. 23 shows how a resist layer 2 of PMMA arranged on a substrate 1 is exposed to synchrotron radiation 5 through a mask. The mask has a membrane 3 which is largely permeable to the synchrotron radiation (for example being made of titanium), onto which an absorber structure 4 made of a material which is highly absorbent of the synchrotron radiation (for example gold) is applied. In the irradiated sections of the resist layer 2 this leads to a transformation of the long-chained molecules of the PMMA into short-chained molecules which, in a wet chemical development step, can be dissolved selectively in relation to the non-irradiated sections and thus removed (see FIG. 24).

Figure 25:
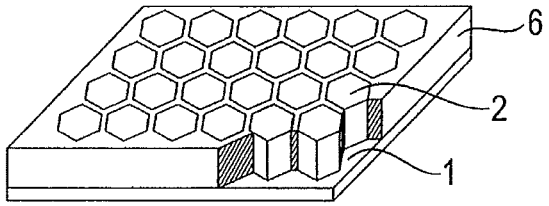
FIG. 25: shows a third step of a method according to the invention.

The resulting free spaces on the substrate 1 are then filled through galvanic deposition of a metal 6 (see FIG. 25). After the remaining resist layer 2 (see FIG. 26) has been dissolved and detached from the substrate 1, the desired structure of the deposited metal 6 is obtained.

Figure 12:
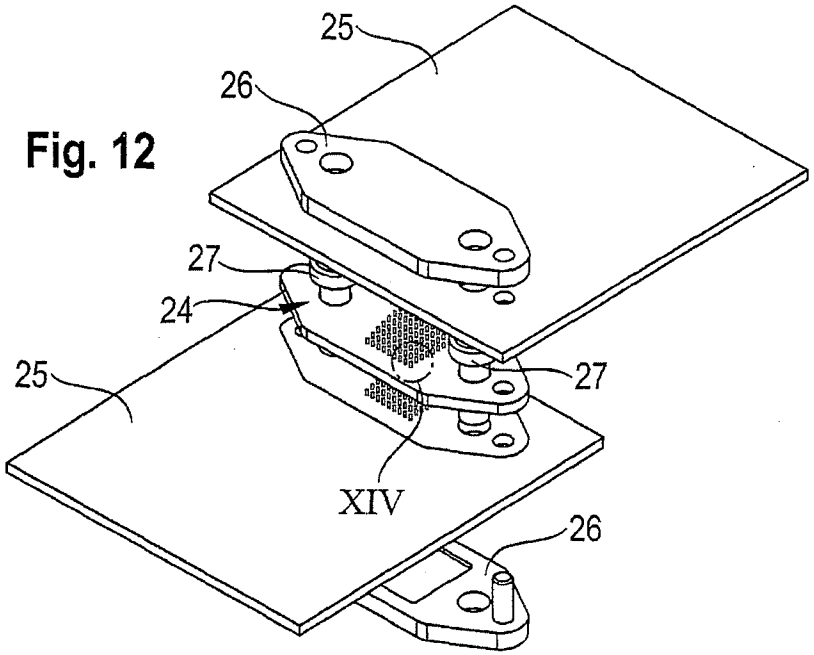
FIG. 12: shows a perspective exploded view of a system consisting of two circuit boards and a contact device according to FIG. 11.
Figure 26:
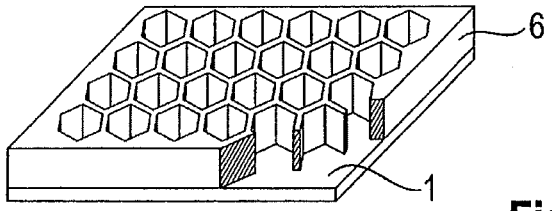
FIG. 26: shows a fourth step of a method according to the invention.

In FIGS. 25 and 26 this is represented by way of example as a random metallic structure. According to the invention the metallic structure takes the form of one or more contact elements 7, connected at defined connection points, as represented in FIG. 12, by way of example, for an embodiment of a contact element 7 according to the invention. Connected contact elements 7 can be isolated by being separated at connection points 8, for example by means of a laser.

The contact element 7 represented in FIGS. 1 to 6 comprises two supporting sections 8, which each form a contact point 9 designed for making contact with a contact region 39 of an element. The contact regions of the elements are thus to be connected in an electrically conductive manner by means of the contact element 7 particularly in order to transmit radio frequency signals. The contact point 9 of a supporting section 8, shown at the top in FIGS. 1 and 2, comprises a contact surface arranged obliquely in relation to a longitudinal axis 10 of the contact element 7 as well as a point extending from this contact surface at the edge. The point serves to penetrate any oxide layer which may be present on the contact region 39 with which contact is to be made and to abrade this as a result of a movement relative to the contact region. This is intended to ensure a good contact with the metal of the contact region lying below the oxide layer.

The two relatively rigid supporting sections 8 are connected with one another via a meander-formed (main) spring section 11. A displacement of the supporting elements 8 relative to one another along the longitudinal axis 10 of the contact element leads to a deformation and pre-tensioning of the (main) spring section 11.

Figure 2:
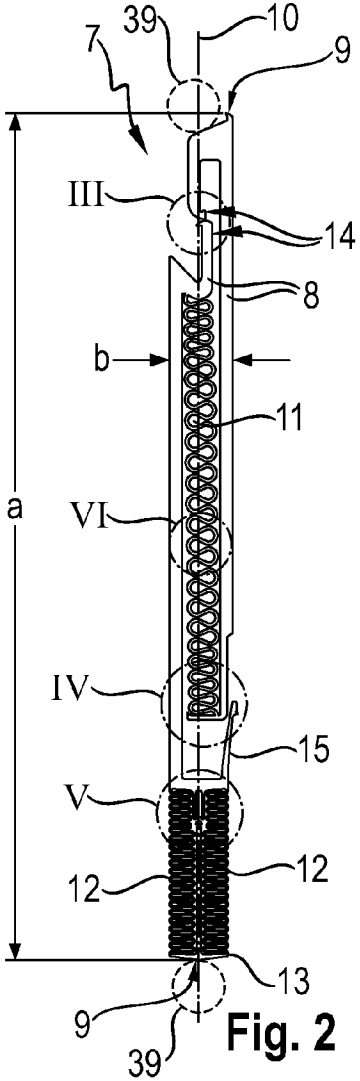
FIG. 2: shows a side view of the contact element according to FIG. 1.
Figure 1:
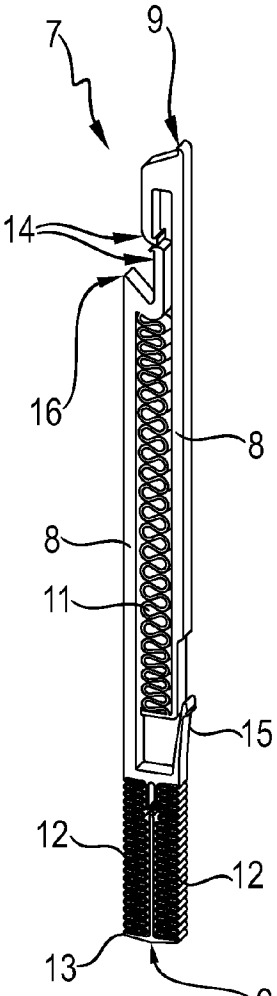
FIG. 1: shows a perspective view of a first embodiment of a contact element according to the invention.

The supporting section 8 shown at the bottom of FIGS. 1 and 2 also has at its lower end two further, also meander-formed, spring sections 12 arranged parallel to one another. These are connected at one end with the lower end of the supporting section 8 and at the other end with the transverse part of a T-formed plunger 13. The slightly curved outer surface of the transverse part facing away from the spring sections 12 forms one contact point 9 of the contact element 7.

Figure 3:
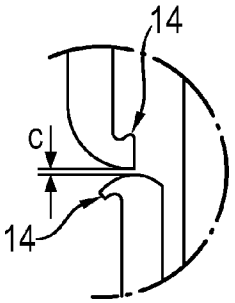
FIG. 3: shows an enlargement of the section III in FIG. 2.

The two supporting sections 8 also each form a locking tab 14 which, together, form a snap-lock connection which, after snapping into engagement, limits a relative displacement of the supporting sections as a result of the (main) spring section 11 then being under tensile load. In FIGS. 1 to 3 the contact element 7 is shown with the snap-lock connection still released, as it is on being manufactured by means of the method according to the invention. By applying pressure to the two ends of the contact element 7, the snap-lock connection can be snapped together with temporary elastic deflection of the sections of the supporting sections 8 which include the locking tabs 14. The (main) spring section 11 is thereby pre-tensioned in a tensile manner.

Figure 5:
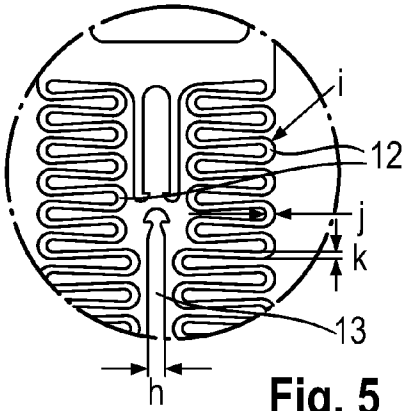
FIG. 5: shows an enlargement of the section V in FIG. 2.

At the same time a functionally corresponding snap-lock connection between the lower supporting section 8 and the plunger 13 is formed, whereby the spring sections 12 is pre-tensioned in a compressive manner (see FIG. 5).

Figure 7:
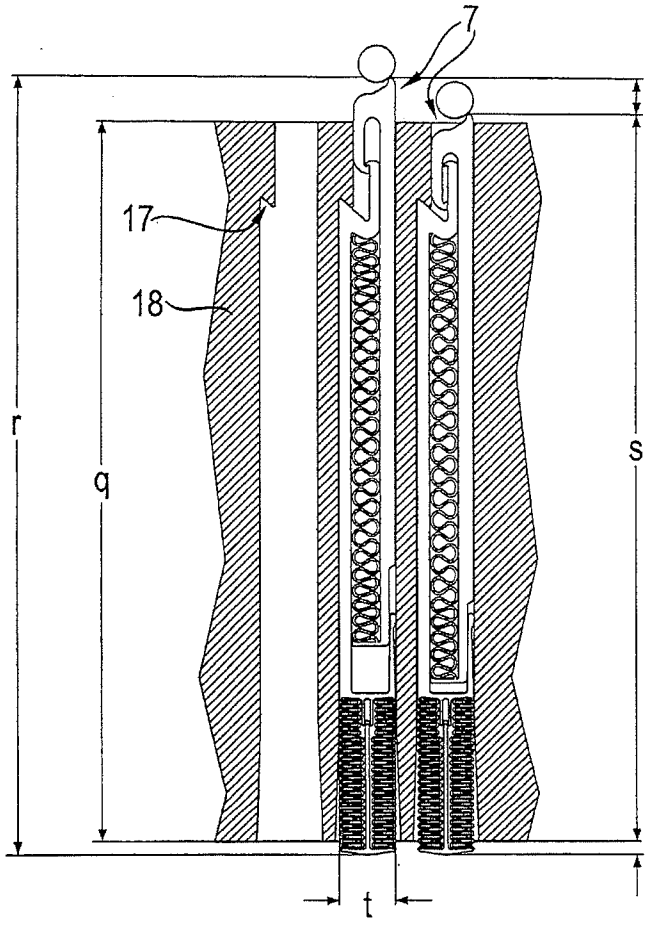
FIG. 7: shows a section of a contact device according to the invention with contact elements according to FIGS. 1 to 6 in a cross section.

The lower supporting section 8 also has a clamping section 15 which is inclined at a slight angle in relation to the longitudinal axis 10 of the contact element 7. As a result of this inclined alignment, the free end of the clamping section 15 is pressed outwards, and thus elastically deflected, through the upper supporting section 8 during its movement relative to the lower supporting section 8. This serves to fix the contact element 7 in a through-opening of a support plate 16 in a force-locking manner, as shown in FIG. 7. This force-locking fixing is intended, in particular, to secure the contact element 7 against being forced downwards out of the through-opening, whereby as a result of the design of the clamping section 15 the laterally-directed pressure is proportional to the force applied to the contact element 7 from above. This allows a secure force-locking fixing to be achieved, even where high forces are applied (from above, with the corresponding opposing forces from below), while at the same time the contact element 7 can be removed from the through-opening without significant application of force once the load on the upper supporting section 8 is relieved.

The fixing of the contact element in the through-opening against a load applied in an upwards direction is achieved in a form-locking manner in that a shoulder 16 of the lower supporting section 8 comes to a stop against a complementary shoulder 17 in the through-opening.

The method according to the invention makes it possible to manufacture extremely small contact elements 7. For example, it can be used to manufacture a contact element 7 which, in terms of the dimensions shown in FIGS. 2 to 7, has the following measurements: a: 5.61 mm; b: 0.424 mm; c: 0.008 mm; d: 0.012 mm; e: 0.012 mm; f: 0.018 mm; g: 0.013 mm; h: 0.028 mm; i: 0.042 mm; j: 0.015 mm; k: 0.01 mm; l: 0.01 mm; m: 0.018 mm; n: 0.01 mm; o: 0.018 mm; p: 0.12 mm (diameter); q: 5.02; r: 5.46 mm; s: 5.11 mm; t: 0.42 mm. The (constant) thickness of this contact element 7 amounts to 0.15 mm.

A section of a contact device according to the invention is illustrated in FIG. 7. This comprises a mounting 18 with a plurality of parallel through-openings, in each of which a contact element is arranged and fixed in the described manner. In FIG. 7, by way of example a contact element 7 is arranged in only two of the three through-openings. In addition, one contact element 7 is held in its neutral position through the snap-lock connection and the other raised to almost the maximum amount. This is intended to illustrate the tolerance compensating function of the (main) spring section 11 of the contact elements 7.

Figure 8:
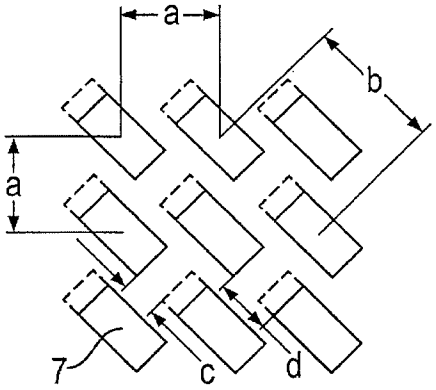
FIG. 8: shows an arrangement of the contact elements in the contact device according to FIG. 7.

The specific arrangement of the through-openings and thus the contact elements 7 in the mounting 18 depends on the function to be achieved with the contact device. FIG. 8 shows a first exemplary arrangement in which a total of nine contact elements 7 are arranged in a square with the individual contact elements 7 being aligned diagonally. It can be the case that (radio frequency) signals are transmitted via the central contact element 7, while the others are connected to ground and serve as the opposite pole. This produces a shielded arrangement of the signal contact element 7, which corresponds functionally to the inner conductor of a conventional coaxial contact element and is at the same time distinguished by extremely small dimensions. The arrangement represented in FIG. 8 can have the following dimensions, as indicated: a: 0.4 mm; b: 0.566; c: 0.15 mm; d: 0.24 mm.

The signal and current path between the two contact points 9 of the contact element 7 is primarily formed by the two supporting sections 8 as well as the plunger 13 connected with the lower supporting section 8, which are distinguished from the spring sections 11, 12 through a greater cross-sectional area and consequently a lower electrical resistance. Through the contact of the two supporting sections 8 or the lower supporting section 8 with the plunger 13 in the region of the snap-lock connections as well as of the clamping section 15, the signal or current path is formed such as to bypass the spring sections 11, 12.

Figure 9:
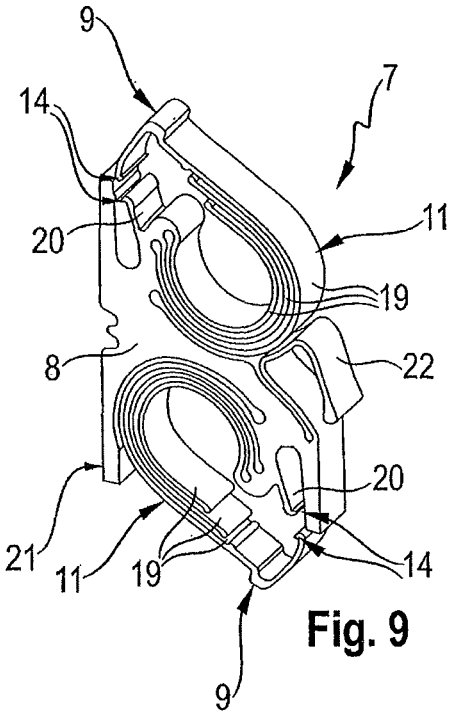
FIG. 9: shows a perspective view of a second embodiment of a contact element according to the invention.
Figure 10:
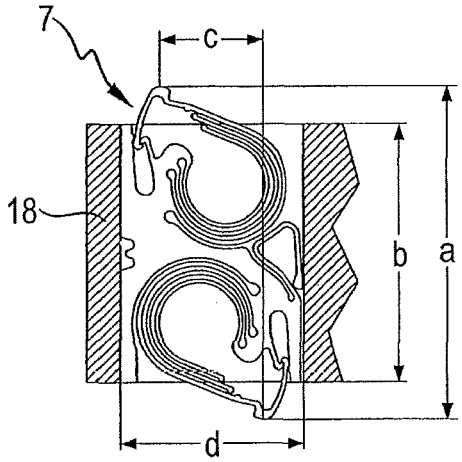
FIG. 10: shows a section of a contact device according to the invention with contact elements according to FIGS. 10 to 12 in a cross section.

FIGS. 9 and 10 show a second embodiment of a contact element 7 according to the invention. This comprises a relatively rigid supporting section 8 as well as two spring sections 11. The spring sections 11 each comprise three curved spring tabs 19, the outermost of which is angled over at its free end. In the region of the angled section the outer spring tabs 19 each form a contact point 9 on their outer side. In addition, the free end of the angled section in each case forms a locking tab 14, which, in combination with the locking tab 14 of one of two locking arms 20 of the supporting section 8, forms a snap-lock connection.

The supporting section 8 forms a contact surface 21 on one side via which the contact element 7 is supported in a through-opening of a mounting 18. In addition, on the opposite side, the supporting section 8 forms a spring tab 22 which, in the through-opening, presses under pre-tension against the adjacent opening wall, and thus increases the friction between the contact surface 21 and the opening wall. This holds the contact element 7 in the through-opening in a force-locking manner (see FIG. 10).

FIG. 9 shows the contact element in the form in which it is manufactured in a method according to the invention. In this form, the snap-lock connections are not engaged, nor do the three spring tabs 19 of the two spring sections 11 make contact with one another. Such a contact as well as the engagement of the snap-lock connections is effected through the application of pressure forces on the two contact points 9 and a resulting deformation of the spring sections 11.

The contact element 7 shown in FIGS. 9 and 10 can for example have the following dimensions, as indicated: a: 1.3 mm; b: 1.0 mm; c: 0.39 mm; d: 0.72 mm. The (constant) thickness of the contact element 7 can amount to 0.15 mm.

Figure 11:
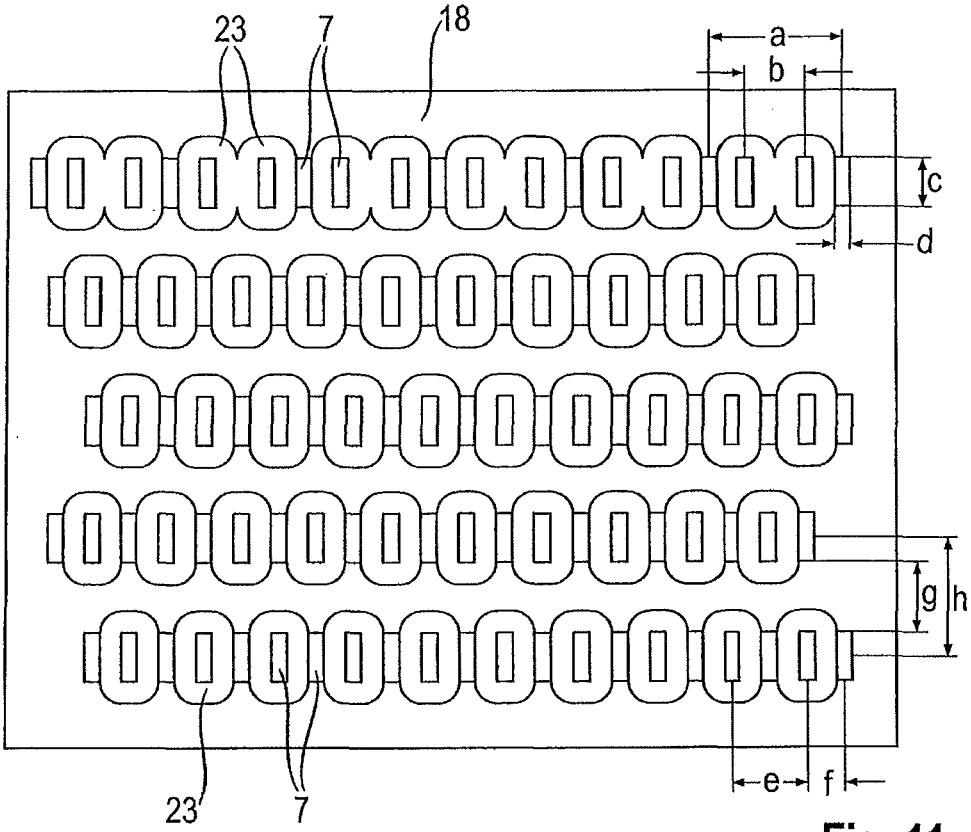
FIG. 11: shows an arrangement of the contact elements in the contact device according to FIG. 12.

FIG. 11 shows a possible arrangement of a plurality of the contact elements 7 shown in FIGS. 9 and 10 in a mounting 18. What is shown is a parallel arrangement in a total of five rows. In the topmost row, an arrangement for a symmetrical signal transmission (100Ω impedance) is selected. The contact elements 7 are thus arranged in pairs for the signal transmission, whereby a contact element 7 connected to ground is arranged to each side of each pair. In contrast, the four lower rows are designed for a single-ended signal transmission (50Ω impedance), so that the signal contact elements 7 and the ground contact element 7 are arranged alternately. The electrical insulation of all signal contact elements 7 is achieved by means of dielectrical mounting elements 23 which each accommodate a signal contact element 7 and are themselves integrated in a mounting 18.

The arrangement represented in FIG. 11 can have the following dimensions, as indicated: a: 1.8 mm; b: 0.8 mm; c: 0.15 mm; d: 0.2 mm; e: 1.0 mm; f: 0.5 mm; g: 0.95 mm; h: 1.6 mm.

Naturally, it is also possible for the contact element 7 represented in FIGS. 9 and 10 to be provided in the arrangement represented in FIG. 8. In this case, possible dimensions can be: a: 0.8 mm; b: 1.13 mm; c: 0.43 mm.

Figure 14:
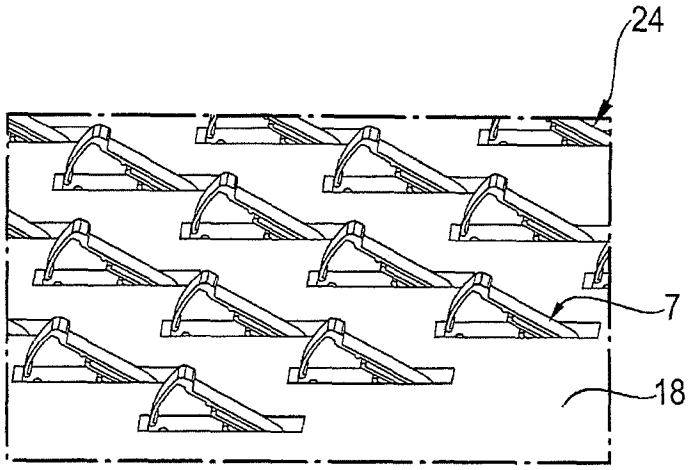
FIG. 14: shows an enlargement of the section XIV in FIG. 12.
Figure 13:
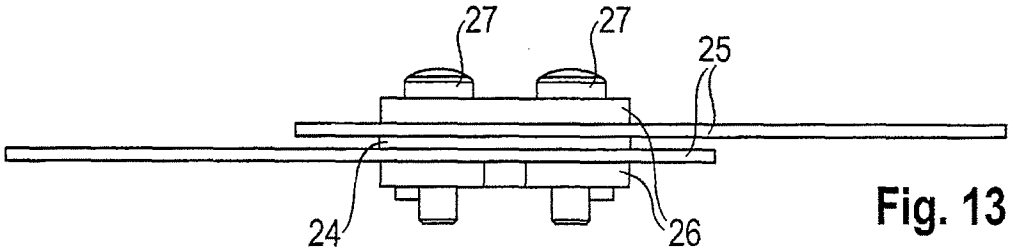
FIG. 13: shows a side view of the system according to FIG. 12.
Figure 16:
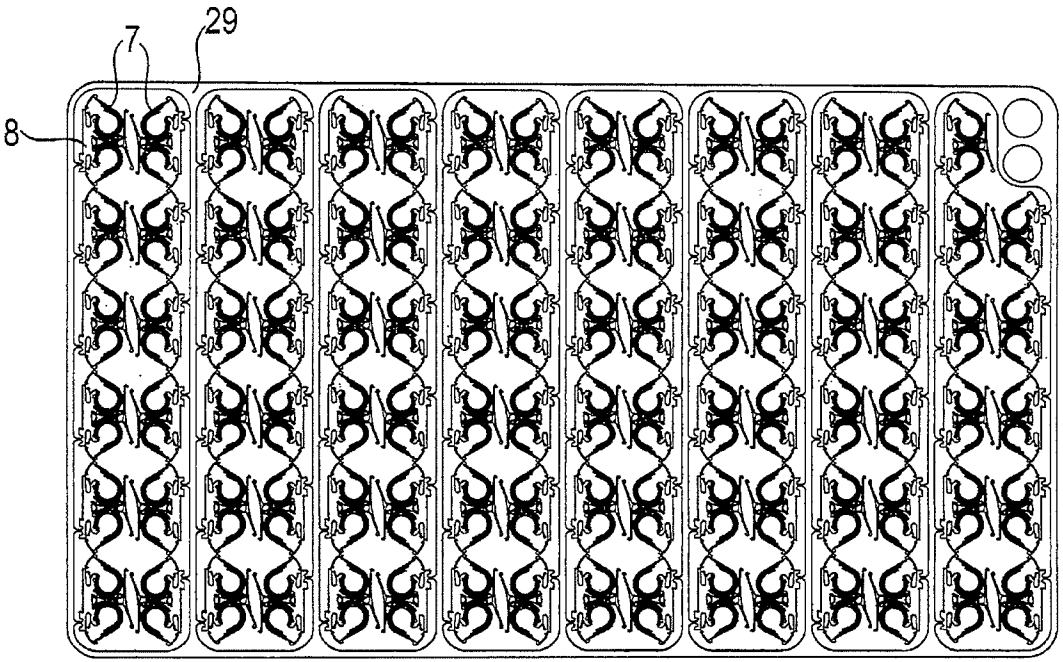
FIG. 16: shows a plurality of jointly manufactured contact elements according to FIG. 15.

FIGS. 12 to 14 show such an arrangement of the contact elements 7 in a board-to-board contact device 24 according to the invention intended for the connection of two circuit boards 25. The fixing of the connection is thereby effected via two pressure plates 26 and screw fixings 27.

Figure 15:
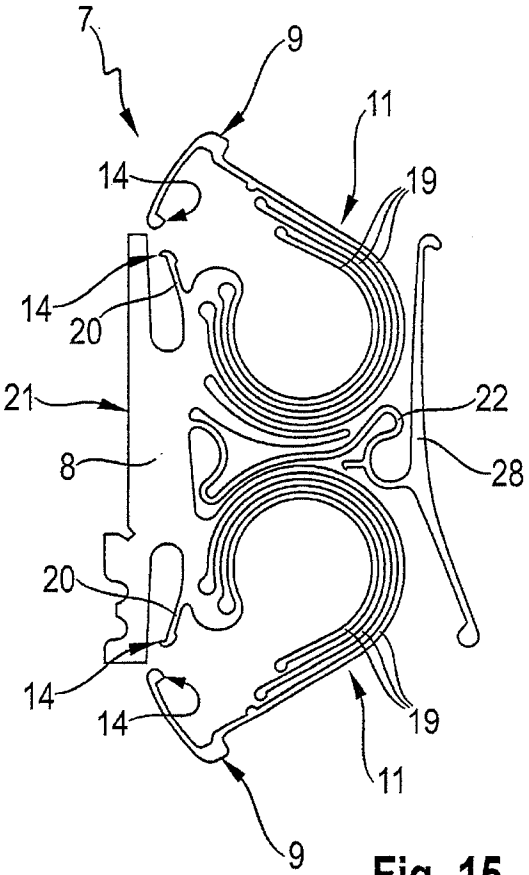
FIG. 15: shows a side view of a third embodiment of a contact element according to the invention.

FIG. 15 shows a third embodiment of a contact element 7 according to the invention. This largely corresponds to that shown in FIGS. 9 and 10, whereby, however, the spring tab 22 serving the purpose of force-locking fixing in a through-opening extends into a clamping strip 28. This allows an improved fixing of the contact element 7 in a through-opening of a mounting 18.

FIG. 16 once again illustrates the simultaneous manufacture of a plurality of contact elements 7 according to the invention in one process operation. It shows a metallic structure manufactured by means of the method according to the invention which comprises the contact elements 7, as well as a frame 29 holding the contact elements 7, in each case via a connection point 8. It shows a total of 95 contact elements 7 which were created on a surface with the dimensions 16.1 mm×9.4 mm.

Figure 19:
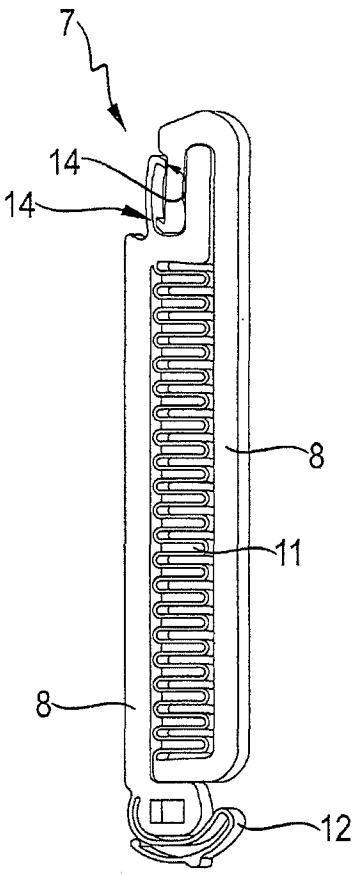
FIG. 19: shows the contact element according to FIG. 17 in a third position.
Figure 18:
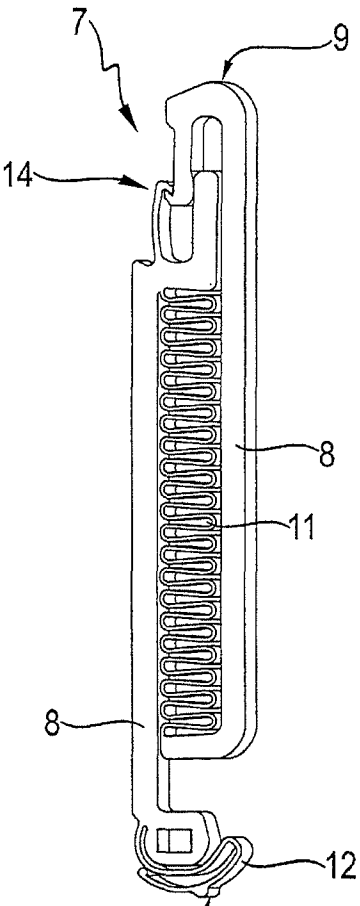
FIG. 18: shows the contact element according to FIG. 17 in a second position.
Figure 17:
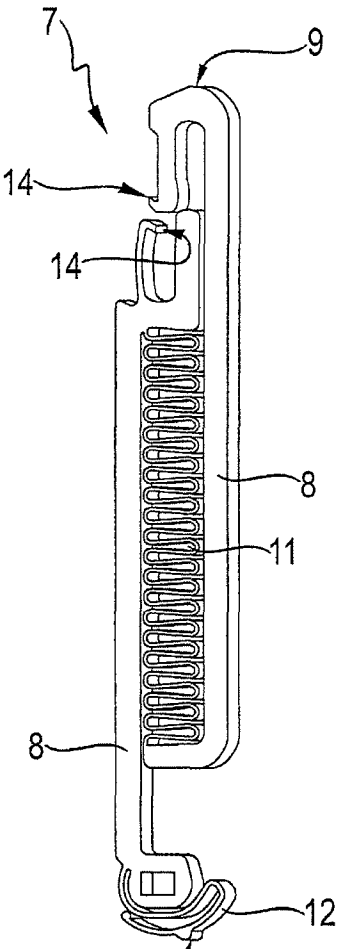
FIG. 17: shows a fourth embodiment of a contact element according to the invention in a first position.
Figure 20:
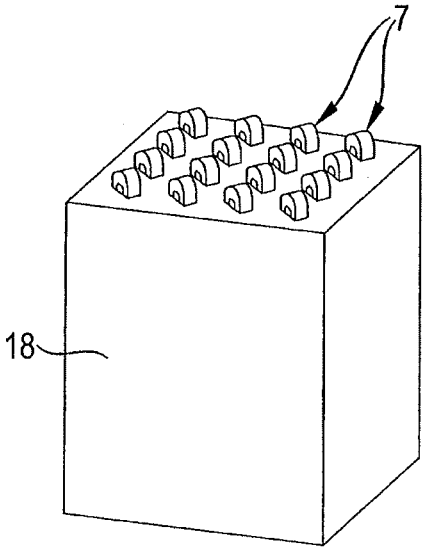
FIG. 20: shows a perspective view of a contact device according to the invention with contact elements according to FIGS. 17 to 19.
Figure 21:
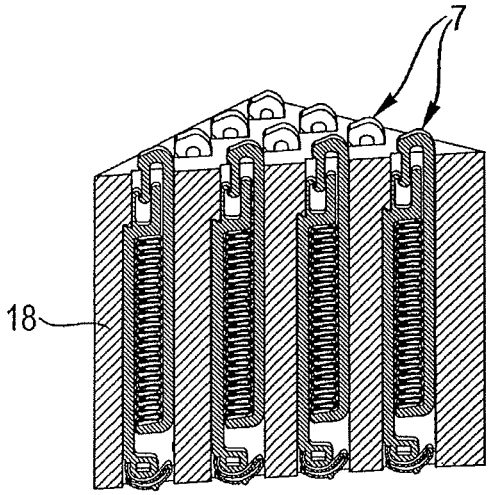
FIG. 21: shows a diagonal section through the contact device according to FIG. 20.

FIGS. 17 to 19 show a fourth embodiment of a contact element 7 according to the invention. This largely corresponds (also in terms of dimensions) to the embodiment according to FIGS. 1 to 6. An important difference is the design of the lower spring section 12, which in this case is designed in the form a curved, double spring tab. FIGS. 17 to 19 show this contact element 7 in different positions. FIG. 17 shows the contact element 7 as it appears directly following its manufacture by means of a method according to the invention. In FIG. 18 the snap-lock connection has already been snapped into engagement, pre-tensioning the (main) spring section 11. This represents a neutral position of the contact element 7 as prepared for use. In this neutral position the contact elements 7 are installed in the through-opening of a mounting 18 of a contact device according to the invention, as represented in FIGS. 20 and 21. FIG. 19 shows the contact element 9 in its compressed state, making use of the entire spring travel provided by the (main) spring section 11.

The extremely low spring forces which can be achieved during the deformation of the spring section(s) 11, 12 of contact elements 7 according to the invention should also be emphasized. For example, the spring force of the (main) spring section 11 of the contact element 7 in FIGS. 17 to 21, pre-tensioned in the neutral position, can only amount to approx. 0.04 N, and in the completely compressed position approx. 0.1 N. The low spring forces are relevant if a plurality of contact elements 7 according to the invention is to be combined in close arrangement in a contact device according to the invention. In this case the total of these spring forces and thus the loading on the elements (circuit boards) which are to be electrically connected and any plugging forces which need to be applied in order to connect the elements is also comparatively low.

Figure 22:
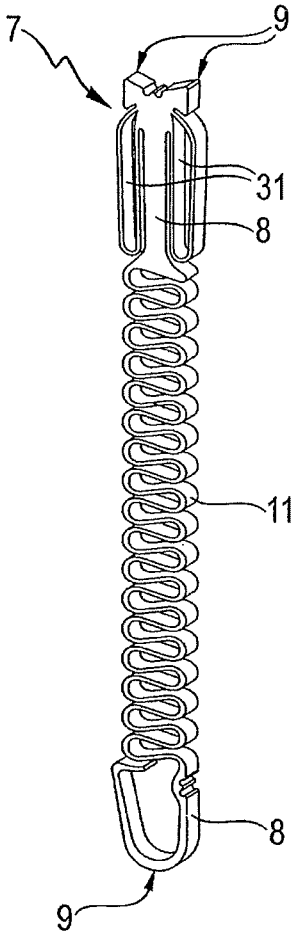
FIG. 22: shows a fifth embodiment of a contact element according to the invention in a first position.

FIG. 22 shows a fifth embodiment of a contact element 7 according to the invention. A special feature of this contact element 7 is that the two supporting sections 8 do not contact one another directly, but are exclusively connected with one another via the (main) spring section 11. In this contact element 7 the (main) spring section 11 thus represents a part of the signal and current path. The fixing of the contact element 7 in a through-opening of a mounting 18 is effected through two spring-mounted clamping sections 31.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A contact element including:

contact points for the electrically conductive connection of contact regions of mutually spaced elements, wherein said contact element is completely formed of one or more deposited materials, of which at least one is electrically conductive;

a spring section which is elastically deformed when contact is made with the contact regions;

a snap-lock connection which holds the contact element in a position in which the spring section is partially deformed; and two rigid supporting sections, wherein in a direction substantially orthogonal to a direction connecting the contact points, the spring section is arranged between the two rigid supporting sections, and the contact element is formed into a single part by material deposition.

2. The contact element of claim 1, wherein the spring section is meander-formed in design.

3. The contact element of claim 1, wherein the spring section includes several coaxially arranged curved spring tabs, such that adjacent spring tabs make contact when contact is made with the contact regions.

4. The contact element of claim 1, wherein on a further deformation of the spring section, the rigid supporting sections forming the snap-lock connection slide against each other.

5. The contact element of claim 1, wherein the snap-lock connection is formed by the rigid supporting sections.

6. The contact element of claim 1, including a signal or current path between the contact points which bypasses the spring section.

7. A method for the manufacture of a contact element comprising forming said contact element using a LiGA method, wherein upon manufacture said contact element includes:

contact points for the electrically conductive connection of contact regions of mutually spaced elements, wherein said contact element is completely formed of one or more deposited materials, of which at least one is electrically conductive;

a spring section which is elastically deformed when contact is made with the contact regions;

a snap-lock connection which holds the contact element in a position in which the spring section is partially deformed; and two rigid supporting sections, wherein in a direction substantially orthogonal to a direction connecting the contact points, the spring section is arranged between the two rigid supporting sections, and the contact element is formed into a single part by material deposition.

8. The method of claim 7, wherein, in said LiGA method, a plurality of connected contact elements is created which contact elements are subsequently separated.

9. The method of claim 7, wherein the contact elements are deformed following manufacture and possibly following separation in order to engage the snap-lock connection.

10. A contact device having a mounting which possesses a plurality of through-openings, as well as having several contact elements each of which include:

contact points for the electrically conductive connection of contact regions of mutually spaced elements, wherein said contact element is completely formed of one or more deposited materials, of which at least one is electrically conductive;

a spring section which is elastically deformed when contact is made with the contact regions;

a snap-lock connection which holds the contact element in a position in which the spring section is partially deformed; and two rigid supporting sections, wherein in a direction substantially orthogonal to a direction connecting the contact points, the spring section is arranged between the two rigid supporting sections, and the contact element is formed into a single part by material deposition, wherein the contact elements are arranged in the through-openings and wherein the sections of said contact elements containing the contact points project beyond the mounting.

11. The contact element of claim 1, wherein the spring section is meander-formed in design.

12. The contact element of claim 11, wherein the spring section includes several coaxially arranged curved spring tabs, such that adjacent spring tabs make contact when contact is made with the contact regions.

13. The contact element of claim 12, wherein on a further deformation of the spring section, the rigid supporting sections forming the snap-lock connection slide against each other.

14. The contact element of claim 11, wherein the snap-lock connection is formed by the rigid supporting sections.

15. The contact element of claim 13, including a signal or current path between the contact points which bypasses the spring section.

* * * * *